US006628162B2

(12) United States Patent
Kondo et al.

(10) Patent No.: US 6,628,162 B2
(45) Date of Patent: Sep. 30, 2003

(54) SEMICONDUCTOR INTEGRATED CIRCUIT

(75) Inventors: Masataka Kondo, Takatsuki (JP); Kiyoto Ohta, Takatsuki (JP); Yuji Yamasaki, Mishima-gun (JP); Toshikazu Suzuki, Nishinomiya (JP); Masanobu Hirose, Kameoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/991,178

(22) Filed: Nov. 16, 2001

(65) Prior Publication Data

US 2002/0075067 A1 Jun. 20, 2002

(30) Foreign Application Priority Data

Nov. 22, 2000 (JP) ..... 2000-356090

(51) Int. Cl.[7] ..... G05F 1/10; G05F 3/02
(52) U.S. Cl. ..... 327/540; 327/543
(58) Field of Search ..... 327/538, 540, 327/541, 543

(56) References Cited

U.S. PATENT DOCUMENTS 5,463,588 A 10/1995 Chonan ..... 365/226
5,751,652 A 5/1998 Tomita ..... 365/226
5,821,808 A * 10/1998 Fujima ..... 327/541
5,831,472 A * 11/1998 Wang et al. ..... 327/543
6,201,378 B1 3/2001 Eto et al. ..... 323/313
6,265,858 B1 * 7/2001 Park ..... 323/313

FOREIGN PATENT DOCUMENTS

JP 09212247 A * 8/1997 ..... G05F/3/24
JP 2000-30450 1/2000

* cited by examiner

*Primary Examiner*—Terry D. Cunningham
*Assistant Examiner*—Quan Tra
(74) *Attorney, Agent, or Firm*—Merchant & Gould P.C.

(57) ABSTRACT

A semiconductor integrated circuit includes a functional circuit and a power source voltage generating circuit used for operating the functional circuit. In the power source voltage generating circuit, output stage transistors are driven by comparing a plurality of reference voltages produced by a plurality of resistors connected in series to one another with output voltages of a plurality of differential amplifiers connected in parallel to one another and varying gate voltages.

18 Claims, 14 Drawing Sheets

SEMICONDUCTOR INTEGRATED CIRCUIT

BACKGROUND OF THE INVENTION

1. Field of the Invention

The present invention generally relates to a semiconductor integrated circuit. In particular, the present invention relates to a power source voltage generating circuit stored in a semiconductor integrated circuit and a method of testing the same.

2. Related Background Art

In a dynamic random access memory (DRAM) that is a memory element for accumulating electric charge in a capacitative element provided at an intersection of a bit line and a word line and recording information, a power source voltage tends to be lowered along with miniaturization of a circuit.

Thus, the capacity of a DRAM tends to decrease in accordance with a reduction in its size. Since the amount of electric charge accumulated in a capacitative element also decreases in a read or write operation, in order to provide sufficient margins to the read or write operation by reducing the influence of a leak, a memory circuit widely is used in which a potential of a bit line is set to be a half of a power source voltage VDD after a read or write operation is completed.

FIG. 13 is a structural view of a representative power source voltage generating circuit typically used for the purpose of generating a half of a power source voltage VDD. In FIG. 13, based on a reference potential VM produced by resistors R1 and R2 and transistors Q1 and Q2, potentials applied to gates of transistors Q3 and Q4 are represented by (VM+VT) and (VM−VT), respectively, where VT is a threshold voltage of the transistors Q1 and Q2.

In the power source voltage generating circuit, since the gate voltages of the transistors Q3 and Q4 are constant, currents Ids3 and Ids4 flowing through the transistors Q3 and Q4 are represented by the following Formula 1.

$$Ids3=(\beta/2)\cdot(W/L)\cdot(VM-VBP)^2$$

$$Ids4=-(\beta/2)\cdot(W/L)\cdot(VM-VBP)^2 \quad (1)$$

Therefore, when a voltage of an output VBP is equal to the reference voltage VM, relationships, Ids3=0 and Ids4=0 are satisfied, whereby the circuit becomes stable. Since a voltage between a gate and a source of the output stage transistor Q3 or Q4 varies while maintaining the relationship of the Formula 1 with respect to an increase or decrease in the voltage VBP, the voltage of the output VBP is raised or lowered by currents supplied from the power source voltage VDD or VSS, so that a potential of the output VBP is kept constant.

However, in the above-described power source voltage generating circuit, since the gate voltages applied to the output stage transistors Q3 and Q4 are constant, the amount of variation in the currents that can be provided due to the change in the voltage between the gate and the source is not large enough. Thus, transient response characteristics are not so good.

In order to improve the transient response characteristic, the capabilities of the output stage transistors Q3 and Q4 are required to increase. In order to realize this, a method of widening the areas of the output stage transistors Q3 and Q4 might be considered first.

However, the above-described method causes problems: (1) an increase in the area of the power source voltage generating circuit itself and (2) an increase in the amount of currents consumed by the power source voltage generating circuit along with the increase in the area thereof.

FIG. 14 is a graph showing a relationship between the output voltage VBP and a current capability IBP of an output buffer. When the areas of the output stage transistors Q3 and Q4 are represented as s(Q3) and s(Q4) respectively, in Q3' and Q4' that are varied in area from the output stage transistors Q3 and Q4 (varied from W to W' in gate length and from L to L' in gate width), the current IBP is (W'/W)·(L/L') times so that the current capability is improved. However, since a leak current Ileak also increases at the same time, it is apparent that the current capability does not necessarily increase effectively with the increase in the area.

As described above, a bit line precharge power source voltage generating circuit typically used is required to improve the transient response characteristic, but in order to realize this without increasing a layout area thereof excessively, the output stage transistors that supply currents for bringing the voltage back to a predetermined value with respect to the change in the output VBP are required to define a circuit capable of flowing currents positively.

SUMMARY OF THE INVENTION

Therefore, with the foregoing in mind, it is an object of the present invention to provide a semiconductor integrated circuit capable of improving a transient response characteristic without increasing a layout area of a power source voltage generating circuit and a method of testing the same.

To achieve the above object, the semiconductor integrated circuit of the present invention includes a functional circuit and a power source voltage generating circuit used for operating the functional circuit. In the power source voltage generating circuit, transistors are driven in which output stages are formed by a pair of differential amplifiers receiving reference voltages having a minute voltage difference at an action point, and in a differential amplifier other than the pair of the differential amplifiers, a reference voltage other than those input to the pair of differential amplifiers is compared with an output voltage from the corresponding transistor among the transistors in their amount.

Because of the above-mentioned construction, when the output voltage varies minutely or sharply, each operating amplifier can be adopted according to either case, whereby it becomes possible to bring the voltage back to a predetermined value with respect to the change of a voltage in a short time.

In the semiconductor integrated circuit of the present invention, it is preferable that the power source voltage generating circuit includes a first resistor, a second resistor, a third resistor, and a fourth resistor connected in series to one another, as well as a first differential amplifier, a second differential amplifier, and a third differential amplifier, and a first transistor, a second transistor, and a third transistor. The first resistor connects a terminal on the opposite side of that connected to the second resistor to a first power source potential and the fourth resistor connects a terminal on the opposite side of that connected to the third resistor to a ground potential. Gate terminals of the first transistor, the second transistor, and the third transistor are connected to output terminals of the first differential amplifier, the second differential amplifier, and the third differential amplifier respectively. Drain terminals of the first transistor, the second transistor, and the third transistor are connected to either the first power source potential or the ground potential. Source terminals of the first transistor, the second transistor, and the third transistor are connected to an output terminal. One input terminal of each of the first differential amplifier, the second differential amplifier, and the third differential amplifier is connected to the output terminal, the other input terminal of the first differential amplifier receives a first reference voltage produced between the first resistor and the second resistor, the other input terminal of the second differential amplifier receives a second reference voltage produced between the second resistor and the third resistor, and the other input terminal of the third differential amplifier receives a third reference voltage produced between the third resistor and the fourth resistor.

Since a gate voltage of a transistor supplying currents in order to generate a predetermined power source voltage can be varied, when the output voltage varies from a predetermined value, the capability of supplying currents largely can be changed. Since a reference voltage of each differential amplifier is varied, a voltage region easily can be produced in which currents are not consumed, whereby it becomes possible to suppress consumption currents during an operation of the power source voltage generating circuit or abnormal variation of the production of the semiconductor circuit.

In the semiconductor integrated circuit of the present invention, it is preferable that the power source voltage generating circuit includes n resistors (n is a natural number) connected in series to one another, (n−1) differential amplifiers disposed between the continuous resistors and (n−1) transistors corresponding to the differential amplifiers respectively. Among the n resistors connected in series to one another, terminals of the resistors disposed on both ends connect terminals not connected to the other resistors to the first power source potential and the ground potential respectively. In each of the differential amplifiers, an output is connected to a gate terminal of the corresponding transistor, one input receives an output voltage connected to a source terminal of the corresponding transistor, and the other input receives a first reference voltage taken out between the corresponding continuous resistors.

Since a gate voltage of a transistor supplying currents in order to generate a predetermined power source voltage can be varied, when the output voltage varies from a predetermined value, the capability of supplying currents largely can be changed. Since a reference voltage of each differential amplifier is varied, a voltage region easily can be produced in which currents are not consumed, whereby it becomes possible to suppress consumption currents during an operation of the power source voltage generating circuit or abnormal variation of the production of the semiconductor circuit.

In the semiconductor integrated circuit of the present invention, it is preferable that among the differential amplifiers constituting the power source voltage generating circuit, an operating power source voltage of the first differential amplifier is driven by the second power source voltage having a higher value than the first power source voltage and the second differential amplifier or the third differential amplifier is driven by the first power source voltage. This is because the output voltage in which the differential amplifiers operate can be set widely by allowing the operating power sources of the differential amplifiers to be independent of those of the driving transistors.

In the semiconductor integrated circuit of the present invention, it is preferable that among the differential amplifiers constituting the power source voltage generating circuit, continuous k differential amplifiers (k is a natural number, $n \geqq k$) are driven by the second power source voltage having a higher value than the first power source voltage, and the remaining continuous differential amplifiers are driven by the first power source voltage. This is because the output voltage in which the differential amplifiers operate can be set widely by allowing the operating power sources of the differential amplifiers to be independent of those of the driving transistors.

In the semiconductor integrated circuit of the present invention, it is preferable that the power source voltage generating circuit has a voltage control unit capable of increasing a resistance in the first and fourth resistors. This is because the output voltage in which the differential amplifiers operate can be set widely by allowing the operating power sources of the differential amplifiers to be independent of those of the driving transistors. Since the output voltage can be set widely, an algorithm is described easily in a test program when setting of voltage due to resistance steps is used for the test program.

It is preferable that in the semiconductor integrated circuit of the present invention, the power source voltage generating circuit has a voltage control unit capable of increasing a resistance in the resistors disposed on both ends among n resistors connected in series to one another. In the semiconductor integrated circuit of the present invention, it is preferable that the voltage control unit is composed of m fuses (m is a natural number) and m resistors in which the m fuses are connected in parallel to both ends, and in the adjoining resistors, a resistance of the output side is twice as high as that of the input side. This is because the output voltage in which the differential amplifiers operate can be set widely by allowing the operating power sources of the differential amplifiers to be independent of those of the driving transistors. Since the output voltage can be set in a wider range, an algorithm is described easily in a test program when the setting of voltage due to resistance steps is used for the test program.

In the semiconductor integrated circuit of the present invention, it is preferable that the power source voltage generating circuit has control terminals capable of stopping power supply to all of the n differential amplifiers. The reason for this is as follows. A test becomes possible while stopping the power source voltage generating circuit, and a functional test is conducted in advance by turning on an external power source, whereby the power source voltage generating circuit needs to operate only in acceptable products, and there is no need for testing all circuits. As a result, the test cost can be reduced.

In the semiconductor integrated circuit of the present invention, it is preferable that the third differential amplifier has the second control terminal, which is connected to the gate terminal of the transistor that is connected in parallel to the current source of the third differential amplifier. By providing a unit for changing the capability of the differential amplifiers temporarily in the circuit, the following circumstance can be prevented previously: supply of the voltages cannot catch up with the number of the activating circuit blocks (becomes insufficient) in a state in which an internal operation requiring the capability of providing a power source varies, e.g., in a state in which the number of the activated circuit blocks increases, so that the consumption of currents of the entire circuit can be reduced.

In the semiconductor integrated circuit of the present invention, it is preferable that the power source voltage generating circuit has the first resistor, the second resistor, the third resistor, and the fourth resistor connected in series to one another, the first differential amplifier, the second differential amplifier, and third differential amplifier, and the first transistor, the second transistor, and the third transistor. The first resistor connects the terminal on the opposite side of that connected to the second resistor to the first power source potential, and the fourth resistor connects the terminal on the opposite side of that connected to the third resistor to the ground potential. The gate terminals of the first transistor, the second transistor, and the third transistor are connected to the output terminals of the first differential amplifier, the second differential amplifier, and the third differential amplifier respectively. The drain terminals of the first transistor, the second transistor, and the third transistor are connected to either the first power source potential or the ground potential. The source terminals of the first transistor, the second transistor, and the third transistor are connected to the output terminal, one input terminal of each of the first differential amplifier, the second differential amplifier, and the third differential amplifier receives the output of the power source voltage generating circuit, the other input terminal of the first differential amplifier receives the first reference voltage produced between the first resistor and the second resistor, the other input terminal of the second differential amplifier receives the second reference voltage produced between the second resistor and the third resistor, and the other input terminal of the third differential amplifier receives the third reference voltage produced between the third resistor and the fourth resistor. Not only a voltage is detected immediately below the power source voltage, but also the operation of the power source circuit can be controlled after checking the power source supply of the entire semiconductor integrated circuit. Even when the entire semiconductor integrated circuit becomes large in scale, a problem of insufficient supply of the power source is solved, and restricted matters can be eased, when the power source voltage generating circuit is adopted.

It is preferable that the semiconductor integrated circuit of the present invention includes wiring for distributing the power source voltage provided from the power source voltage generating circuit to the entire circuit and wiring for measuring a voltage from the farthest position in the provided power source voltage independently, wherein in the power source voltage generating circuit, one input terminal of each of the first differential amplifier, the second differential amplifier, and the third differential amplifier is connected to the end portion of the wiring for measuring the power source voltage. Not only a voltage is detected immediately below the power source voltage, but also the operation of the power source circuit can be controlled after checking power source supply of the entire semiconductor integrated circuit. Even when the entire semiconductor integrated circuit becomes large in scale, a problem of insufficient supply of the power source is solved, and restricted matters can be eased, when the power source voltage generating circuit is adopted.

The method of testing a semiconductor integrated circuit of the present invention is characterized by stopping the power source voltage generating circuit, testing all circuits by supplying a voltage equal to that of the power source voltage generating circuit from an outside, controlling voltages of the circuits that are determined as acceptable products as a result of the test of all circuits, and testing a function of the entire semiconductor integrated circuit by operating the power source voltage generating circuit.

According to the construction described above, a test becomes possible while stopping the power source voltage generating circuit, and a functional test is conducted in advance by turning on an external power source, whereby the power source voltage generating circuit needs to operate only in acceptable products, and there is no need for testing all circuits. As a result, the test cost can be reduced.

DETAILED DESCRIPTION OF THE INVENTION

Figure 1:
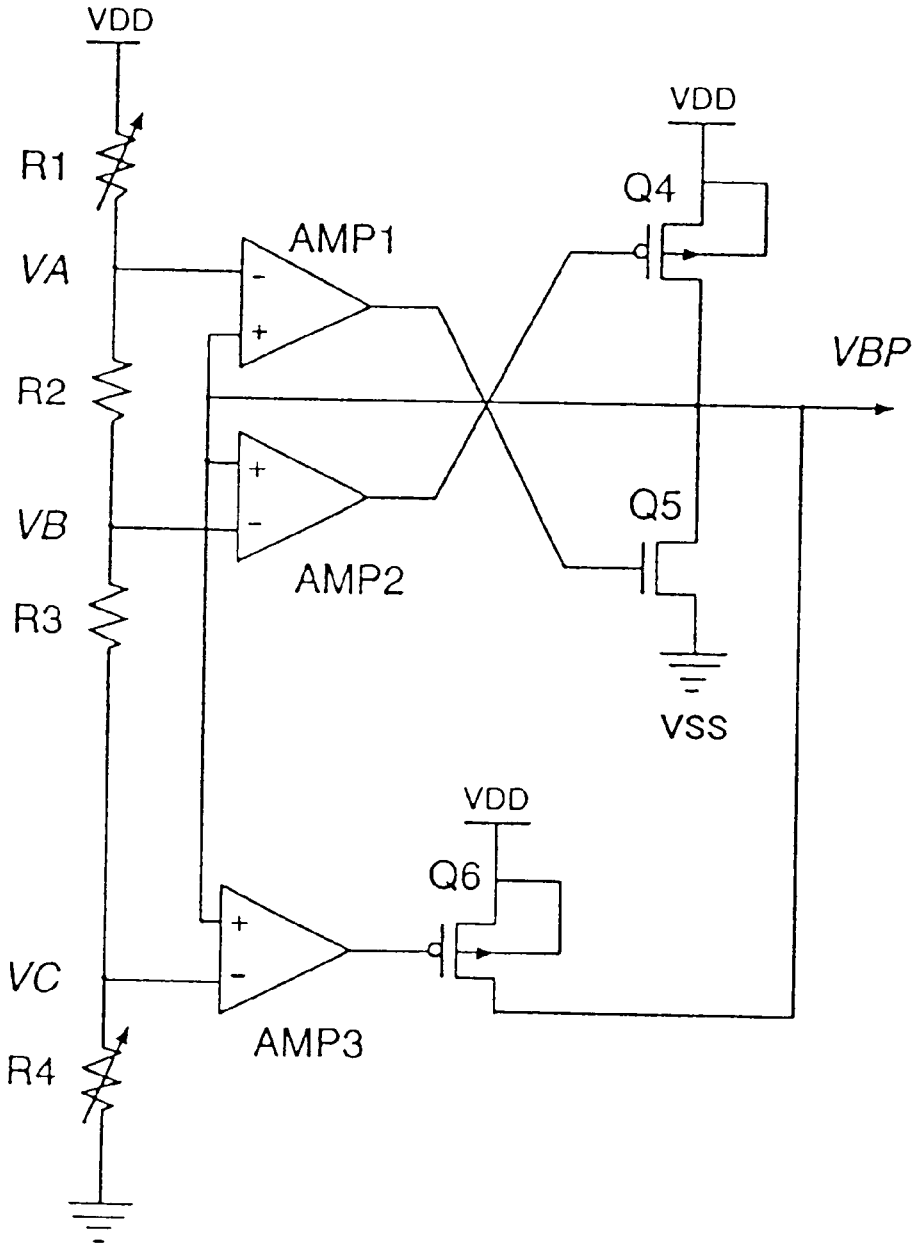
FIG. 1 is a block diagram of a semiconductor integrated circuit of an embodiment according to the present invention.
Figure 2:
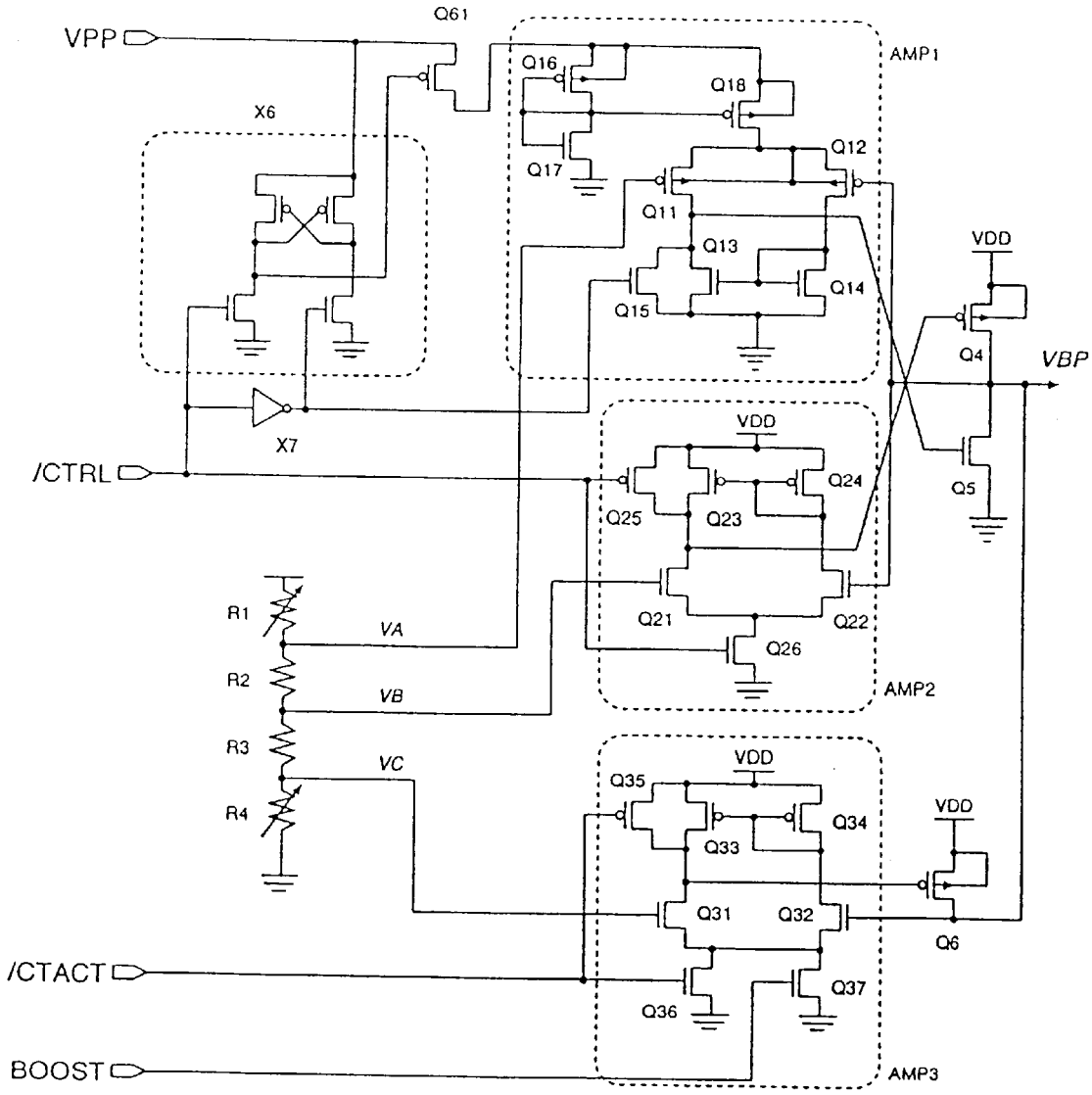
FIG. 2 is a circuit diagram of the semiconductor integrated circuit of an embodiment according to the present invention.

Hereinafter, a semiconductor integrated circuit according to the present invention will be described by way of an embodiment with reference to the drawings. FIG. 1 is a schematic block diagram of the semiconductor integrated circuit of an embodiment according to the present invention. FIG. 2 is an exemplary view showing the mounting of the semiconductor integrated circuit shown in FIG. 1, described as a transistor.

In FIG. 1, reference voltages VA, VB, and VC are produced from reference potentials produced by resistors R1, R2, R3, and R4. It is assumed that a first reference voltage VA and a second reference voltage VB are applied to negative inputs of differential amplifiers AMP1 and AMP2 respectively. It also is assumed that an output VBP is applied to positive inputs of the differential amplifiers AMP1 and AMP2.

Furthermore, it is assumed that outputs of the differential amplifiers AMP1 and AMP2 are applied to gate terminals of an N-channel transistor Q5 and a P-channel transistor Q4 respectively, and a drain terminal and a source terminal of the P-channel transistor Q4 are connected to a power source voltage VDD and an output terminal VBP respectively. The transistor Q5 has the same construction in which a drain terminal and a source terminal thereof are connected to a ground voltage VSS and the output terminal VBP respectively.

As shown in FIG. 1, the above-described circuit has a construction in which a third reference voltage VC is connected to a negative input terminal of a third differential amplifier AMP3, in which the output terminal VBP is connected to a positive input terminal of the third differential amplifier AMP3 and an output terminal of the third differential amplifier AMP3 is connected to a gate terminal of a P-channel transistor Q6. A drain terminal and a source terminal of the transistor Q6 are connected to a power source voltage VDD and the output terminal VBP respectively. The transistor Q6 is larger than the transistors Q4 and Q5, and its current capability is sufficiently greater than those of the transistors Q4 and Q5.

The semiconductor integrated circuit shown in FIG. 2 includes two-system control signals, i.e., /CTRL and /CTACT as control terminals from an outside. It is assumed that both of these control signals /CTRL and /CTACT typically are set at a high level. When a signal input from the control signal /CTRL changes to be at a low level, a voltage applied to a gate terminal of a transistor Q61 through a voltage conversion circuit X6 becomes at a high level equal to that of a second power source voltage VPP, and the transistor Q61 is set in an inactive state, which stops providing the differential amplifier AMP1 with the power source voltage VPP.

A reversal signal of the control signal /CTRL is generated by an inverter X7. However, when the control signal /CTRL is at a low level, an N-channel transistor Q15 is in an ON state, which sets a gate potential applied to the transistor Q5 at a low level. At the same time, a P-channel transistor Q25 that is a component of the differential amplifier AMP2 also is in an ON-state, which sets a gate potential of the transistor Q4 at a high level, and stops the supply of currents from transistors Q3 and Q4 to the output terminal VBP. Along with this, a transistor Q26 is set in an OFF state by the control signal /CTRL, whereby both the differential amplifiers AMP1 and AMP2 are in a stopped state.

On the other hand, the second control signal /CTACT works for controlling an operational state of the differential amplifier AMP3. When the control signal /CTACT is at a high level, transistors Q35 and Q36 are in an OFF and an ON state respectively, and the differential amplifier AMP3 is activated to supply currents to the transistor Q6. However, when the control signal /CTACT becomes at a low level, a potential provided to a gate terminal of the transistor Q6 changes to be the power source voltage VDD, and simultaneously the transistor Q36 becomes in an OFF state so that the differential amplifier AMP3 assumes a stopped state.

The reference voltages VA, VB, and VC produced by the resistors R1, R2, R3, and R4 can adopt different values respectively. According to the present embodiment, the reference voltages VA, VB, and VC have respective voltage differences. Thus, the voltages of the differential amplifiers AMP1 and AMP2 are set so as to be operated when the output voltage VBP is higher than the reference voltage VA, or the output voltage VBP is lower than the reference voltage VB. In a voltage range of VA>VBP>VB, a comparison operation is not conducted by the differential amplifiers AMP1 and AMP2. This is intended to avoid a malfunction with respect to a fluctuation in threshold value of the transistors, caused by variations in the manufacturing process of a circuit due to dispersion, whereby a voltage region is determined in which the transistors Q4 and Q5 do not supply currents.

The reference voltage VC is set to satisfy the relationship of VC<VB and has a function of preventing currents supplied by the transistor Q6 driven by the differential amplifier AMP3 from excessively increasing the pressure of the output voltage VBP.

As shown in FIG. 2, the polarities of the differential amplifiers AMP1 and AMP2 are set to be symmetrical. That is to say, the differential amplifier AMP1 driving the N-channel transistor Q5 has a construction in which a current mirror circuit is composed of N-channel transistors Q13 and Q14, and P-channel transistors Q11 and Q12 are used for comparing an input voltage of the reference voltage VA with that of the output voltage VBP. At the same time, the differential amplifier AMP2 driving the P-channel transistor Q4 has a construction in which a current mirror circuit is composed of P-channel transistors Q23 and Q24, and N-channel transistors Q21 and Q22 are used for receiving the reference voltage VB and the output voltage VBP.

Because of the above-mentioned construction, when a voltage for driving the N-channel transistor Q5 includes the output voltage VBP, currents flowing through the P-channel transistor Q4 are suppressed. Furthermore, when a voltage for driving the P-channel transistor Q4 includes the output voltage VBP, currents flowing through the N-channel transistor Q5 are suppressed. FIG. 3A shows the symmetrical characteristics of the transistors Q4 and Q5 in their current capabilities with respect to the fluctuation in the voltage of the output VBP.

Figure 3B:
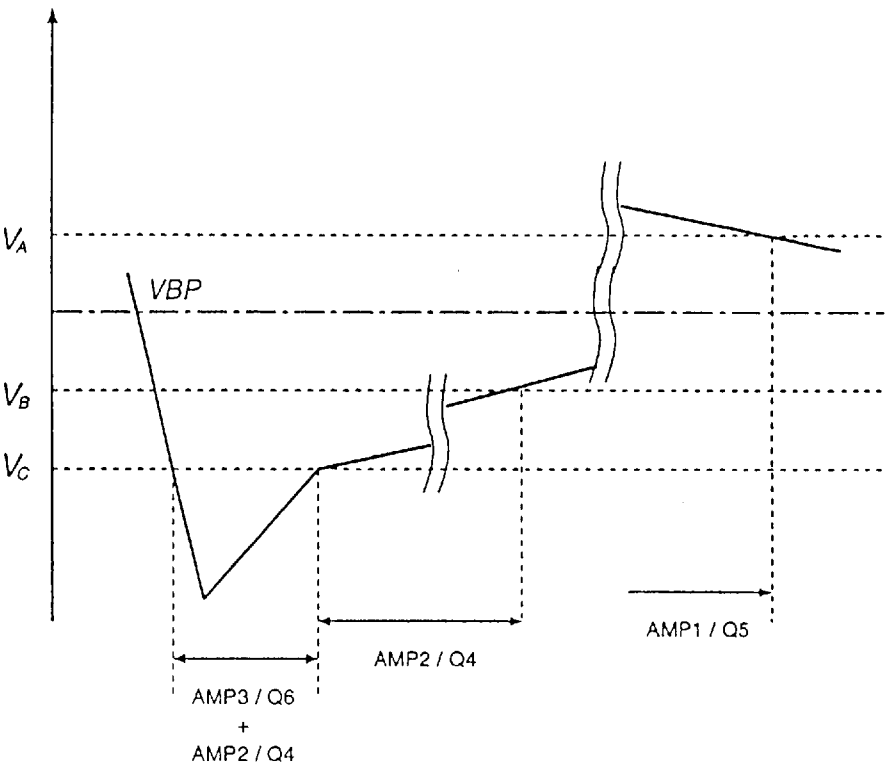
FIGS. 3A and 3B are diagrams showing operational characteristics of the semiconductor integrated circuit of an embodiment according to the present invention.
Figure 3A:
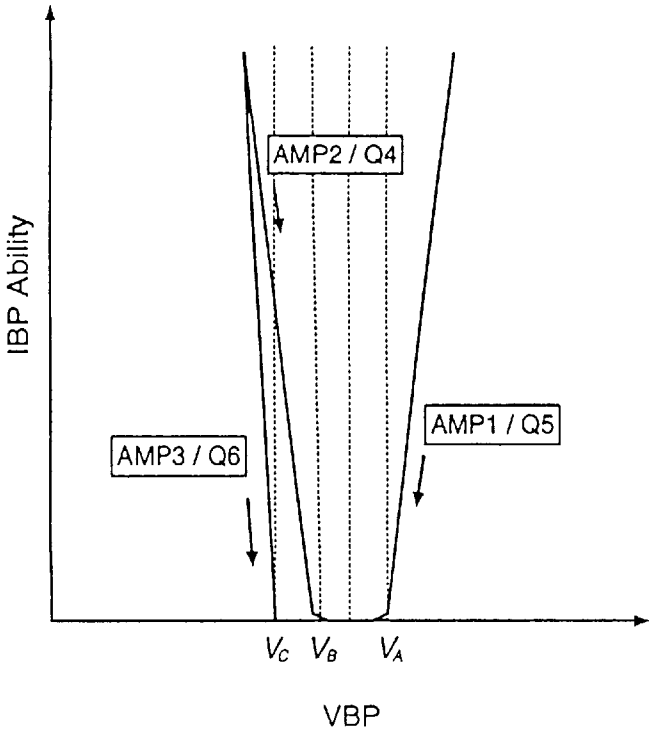

FIG. 3B shows the fluctuation characteristics of the output voltage VBP of the transistors Q4, Q5, and Q6 driven by the differential amplifiers AMP1, AMP2, and AMP3. When the output voltage VBP rapidly decreases and the relationship VBP<VC is established, the differential amplifiers AMP2 and AMP3 simultaneously react and try to bring the output voltage VBP back to the reference voltage VC. Hereafter, only the differential amplifier AMP2 operates to bring the output voltage VBP back to the reference voltage VB. When the relationship VBP>VA is established, the differential amplifier AMP1 operates to bring the output voltage VBP back to the reference voltage VA.

As shown in FIG. 2, a transistor Q37 used as a current source of the differential amplifier AMP3 is provided independently of the typical current source, wherein a drain terminal and a gate terminal are supplied with a ground potential and a control signal BOOST respectively. The control signal BOOST typically is at a low level and is a logic control signal that assumes a high level with the largest voltage value VDD. The control signal BOOST is introduced from outside of the power source, and may be either an output of a logic circuit provided in the semiconductor integrated circuit or an input given from an external terminal of the semiconductor integrated circuit.

Figure 4:
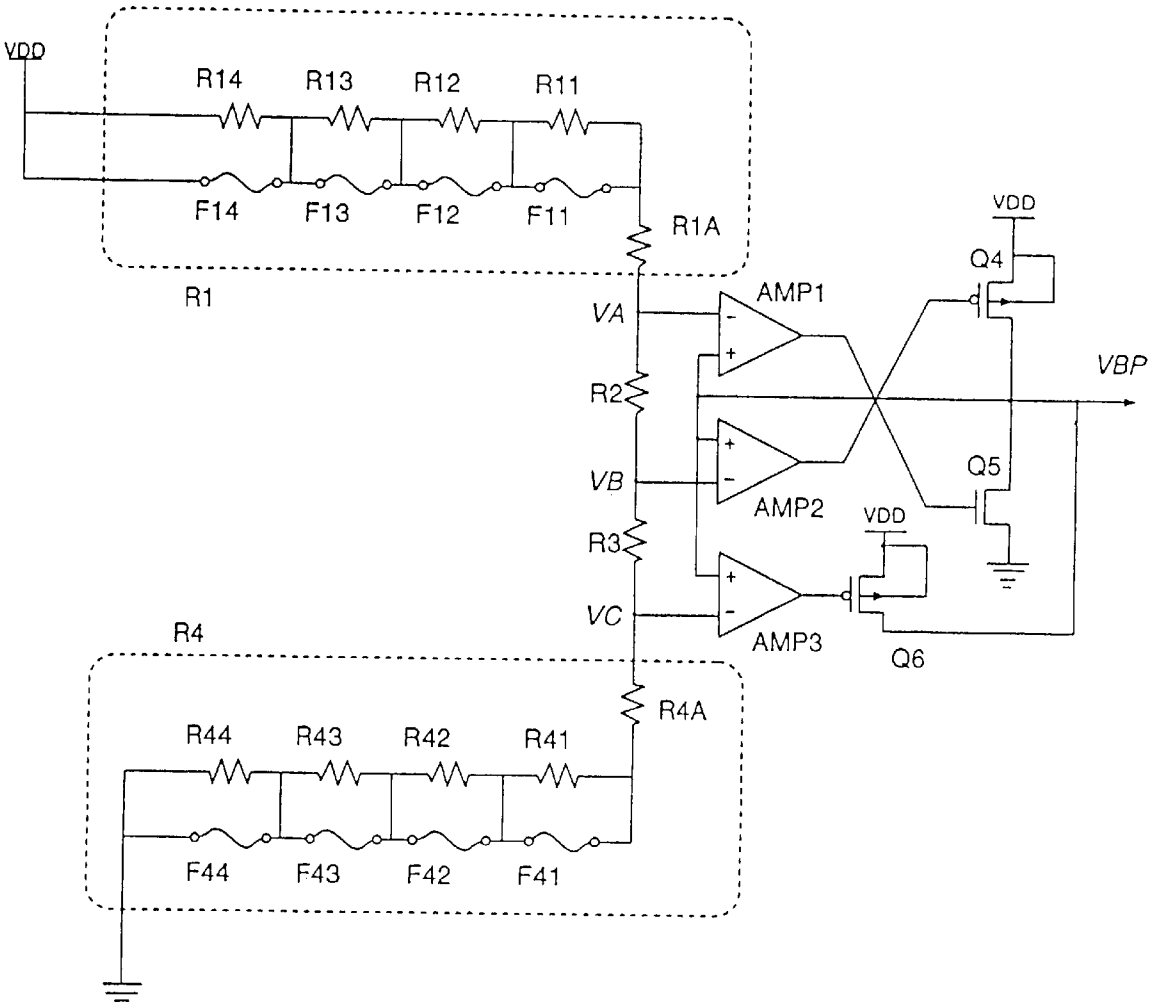
FIG. 4 is an explanatory view of a voltage control unit in the semiconductor integrated circuit of an embodiment according to the present invention.

Next, a resistance control unit provided in the semiconductor integrated circuit shown in FIG. 4 will be described. The resistor R1 is composed of resistors R11, R12, R13, R14, and R1A and fuses F11, F12, F13, and F14, wherein the fuses F11 to F14 are connected to both end terminals of the resistors R11 to R14 respectively and the entire resistance typically is R1A. Similarly, the resistor R4 also is composed of resistors R41, R42, R43, R44, and R4A and fuses F41 to F44 connected to both end terminals of the resistors R41 to R44 respectively. The magnitude of the resistances is set so as to increase as follows: R12=2×R11, R13=2×R12, and R14=2×R13. Similarly, also in the resistors R41 to R44 are designed so that the maximum increase in resistance of R11×15 and R41×15 can be obtained according to the disconnection of the fuses.

According to the present invention, in order to increase the range of the voltage control in which a power source circuit can operate, operation voltages of the differential amplifiers are controlled, which details are described as follows.

Figure 5:
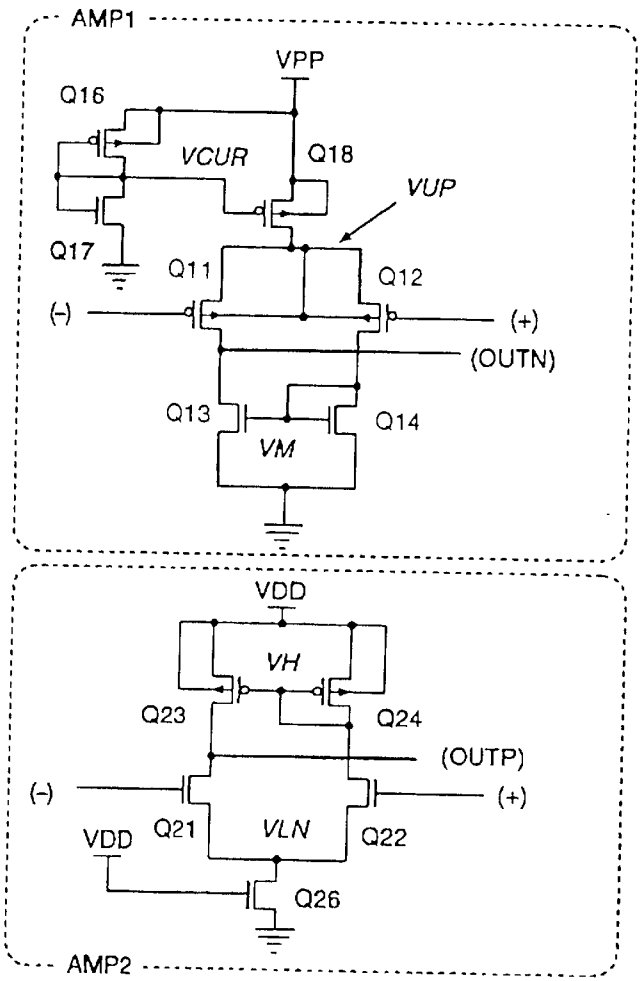
FIG. 5 is a circuit diagram of a differential amplifier of the semiconductor integrated circuit after an improvement in characteristics of an embodiment according to the present invention.
Figure 5:
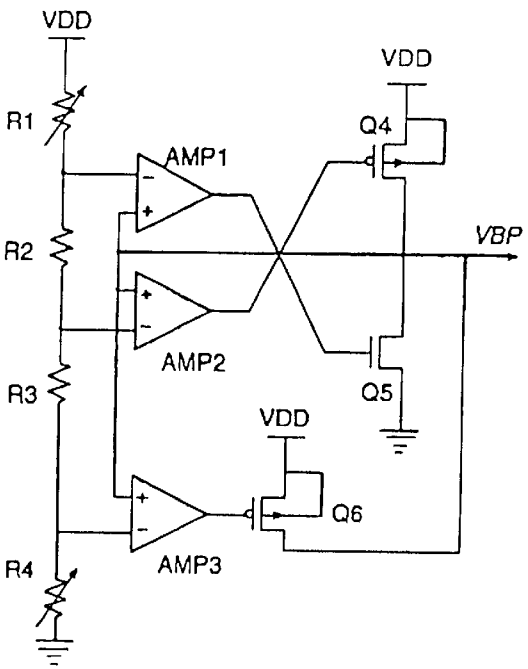

FIG. 5 shows a circuit in which the differential amplifier AMP1 in FIG. 1 is used as a transistor. In FIG. 5, a voltage driving the differential amplifier AMP1 is set to be a second power source voltage VPP that is higher than a first power source voltage VDD.

A voltage VCUR is produced, which is lowered by a P-channel transistor Q16 and an N-channel transistor Q17, and the VCUR is input to a gate terminal of a P-channel transistor Q18. A drain terminal and a source terminal of the transistor Q18 are connected to the second power source voltage VPP and a node VUP of the differential amplifier AMP1 respectively and functions as a current source for activating the differential amplifier AMP1.

Figure 6:
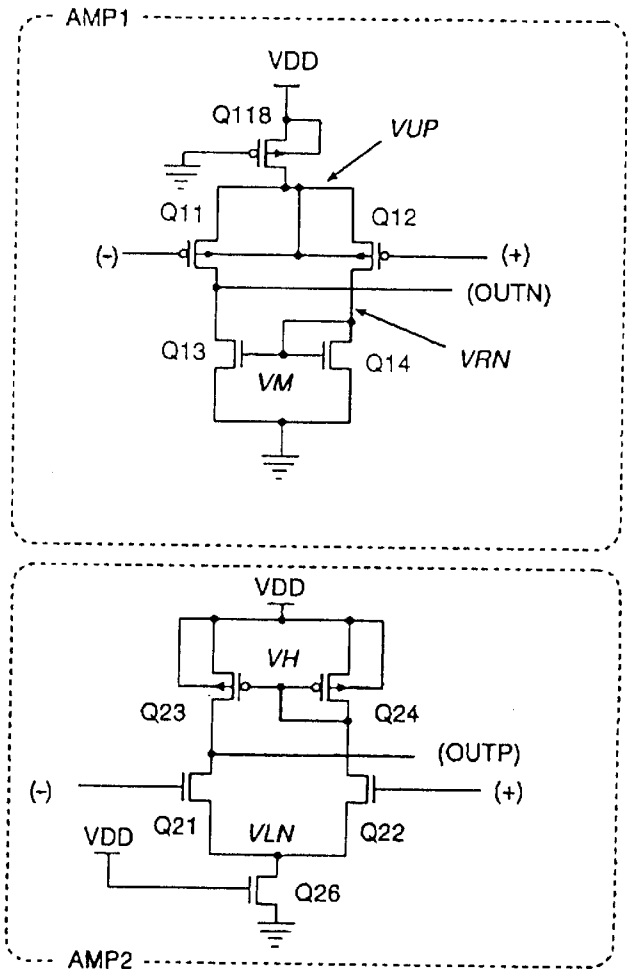
FIG. 6 is a circuit diagram of the differential amplifier before the improvement in characteristics.
Figure 6:
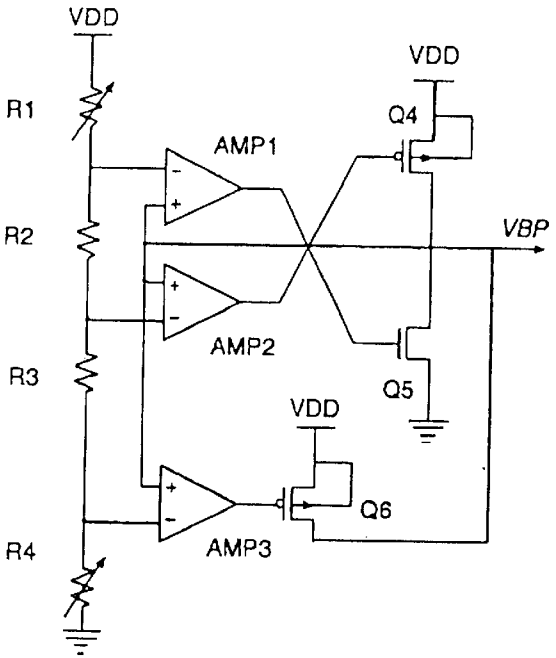

The effects of the present invention will be described with reference to FIGS. 5, 6, 7, and 8. FIG. 6 shows a circuit in which a current supply source of the conventional differential amplifier AMP1 is set to be the first power source voltage VDD for the purpose of comparing the circuit with the semiconductor integrated circuit according to the present embodiment shown in FIG. 5.

In the same way as in the circuit shown in FIG. 5, in FIG. 6, a current mirror circuit is composed of the N-channel transistors Q13 and Q14 and an input transistor that conducts a differential amplification is composed of the P-channel transistors Q11 and Q12. A drain terminal, a gate terminal, and a source terminal of a P-channel transistor Q118 that is a current supply source are connected to the internal node VUP, the ground potential VSS, and the first power source potential VDD respectively.

Figure 7:
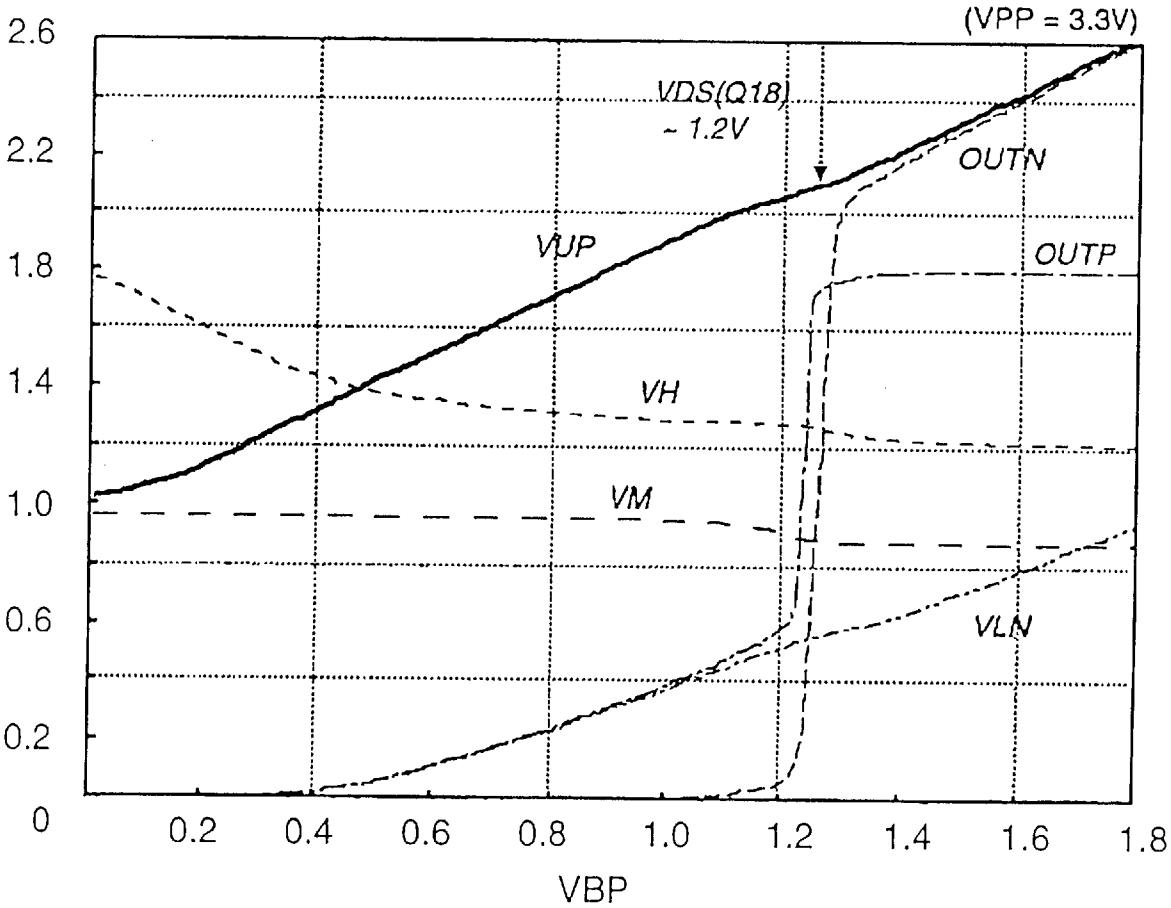
FIG. 7 is an operational characteristic diagram of the semiconductor integrated circuit after the improvement in characteristics of an embodiment according to the present invention.
Figure 8:
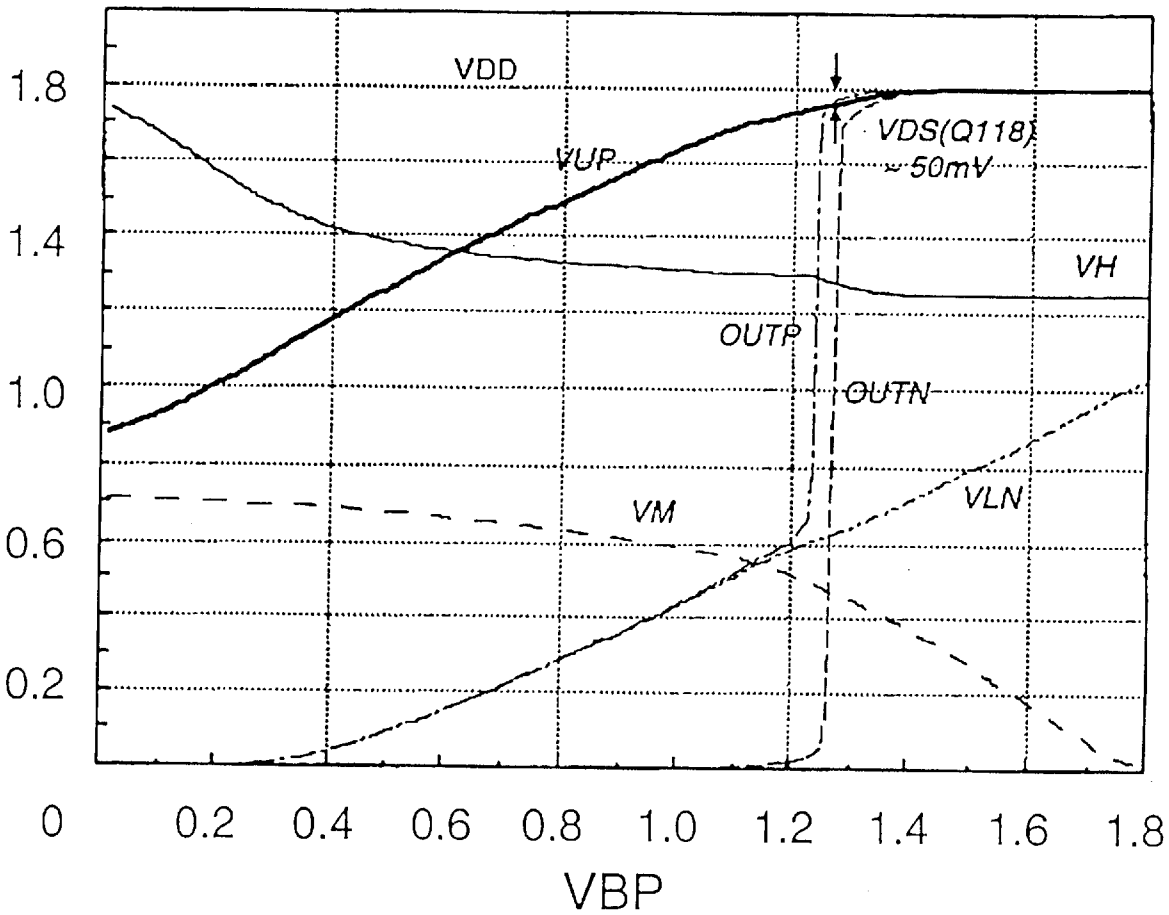
FIG. 8 is an operational characteristic diagram of the semiconductor integrated circuit before the improvement in characteristics.

When an intended reference potential of each circuit is described as an intermediate VREF between the reference potentials VA and VB, the output voltage VBP is varied from 0 V to 1.8 V in such a manner that the relationships of VREF=1.25 V, VDD=1.8 V and VPP=3.3 V are established. FIGS. 7 and 8 are graphs showing the fluctuations in a voltage of the internal node VUP of the differential amplifier in FIGS. 5 and 6.

FIGS. 7 and 8 show plots of the voltages at each node of a pair of amplifiers AMP1 and AMP2 in FIGS. 5 and 6 and show a voltage dependence on the input VBP to the differential amplifiers.

In a graph of FIG. 7 showing the results of the circuit (FIG. 5) adopted in the embodiment of the present invention, when the output voltage VBP is equal to the intended voltage VREF, a potential difference between a drain terminal and a source terminal of a transistor Q18 is approximately 1.2 V, and even when the output voltage VBP is set to be either higher or lower than the intended voltage VREF, the capability of supplying currents through the transistor Q18 is not lost so that the setting voltage is not limited.

On the other hand, in a graph in FIG. 8 showing the results of the conventional circuit (FIG. 6), when the output voltage VBP approaches the intended voltage VREF, the voltage of the node VUP gets closest to the first power source potential VDD and a potential difference between the drain terminal and the source terminal of the transistor Q118 that is a current source is estimated at approximately 50 mV. As a result, the transistor Q118 is supplied with few currents so that the differential amplifier does not operate normally.

As described above, in the embodiment according to the present invention, by allowing the second power source voltage VPP that is higher than the first power source voltage VDD to be a current supply source, the setting voltage of the output voltage VBP is not limited particularly, which can prevent the differential amplifier from operating abnormally.

The control signal /CTRL is a signal input from the outside of the power source circuit and is either an output signal of a logic circuit formed in a control circuit of a DRAM or a signal directly input from an external input terminal of the semiconductor device.

Figure 9:
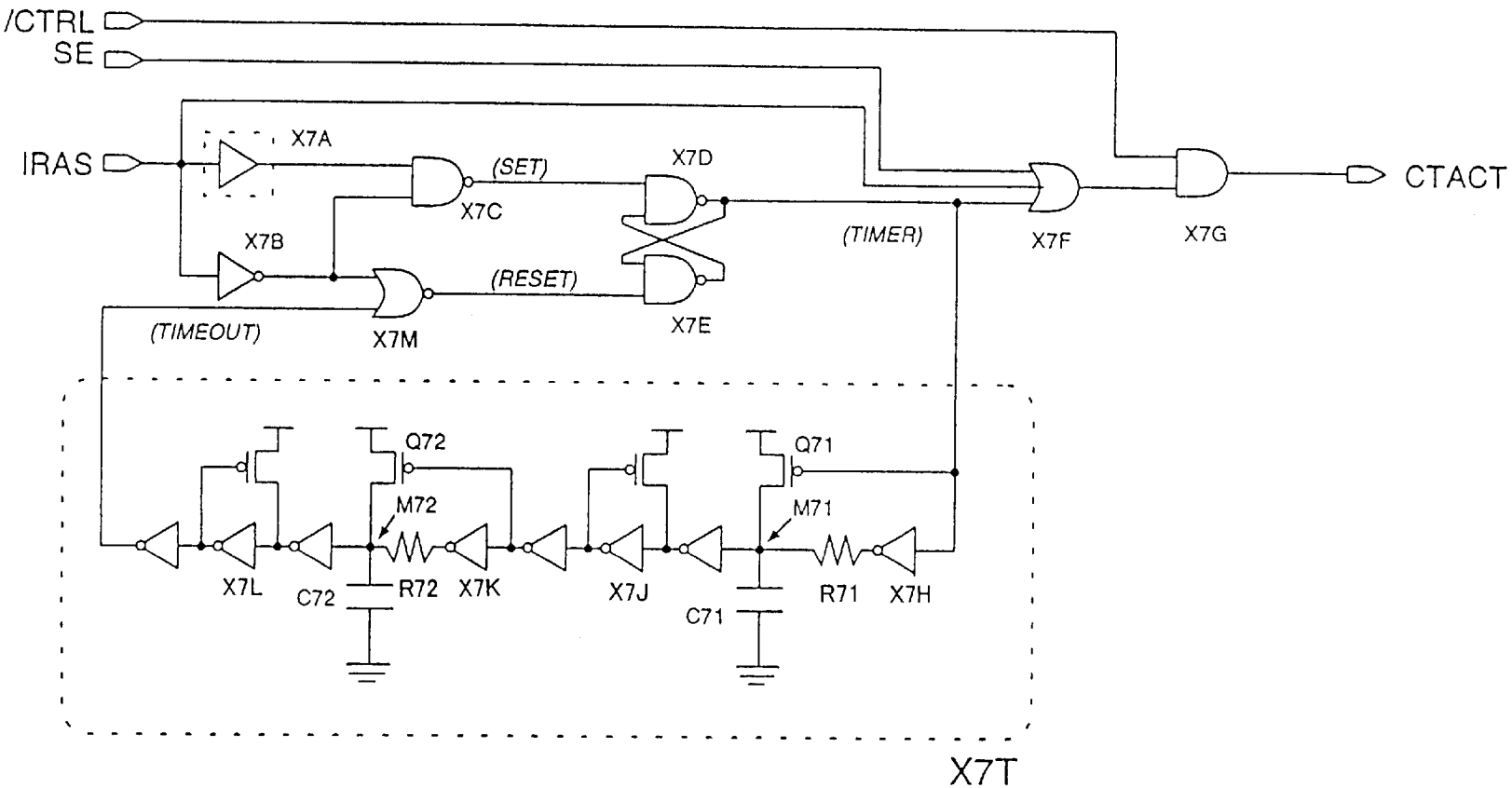
FIG. 9 is an exemplary view of a control signal generating circuit in the semiconductor integrated circuit of an embodiment according to the present invention.
Figure 10:
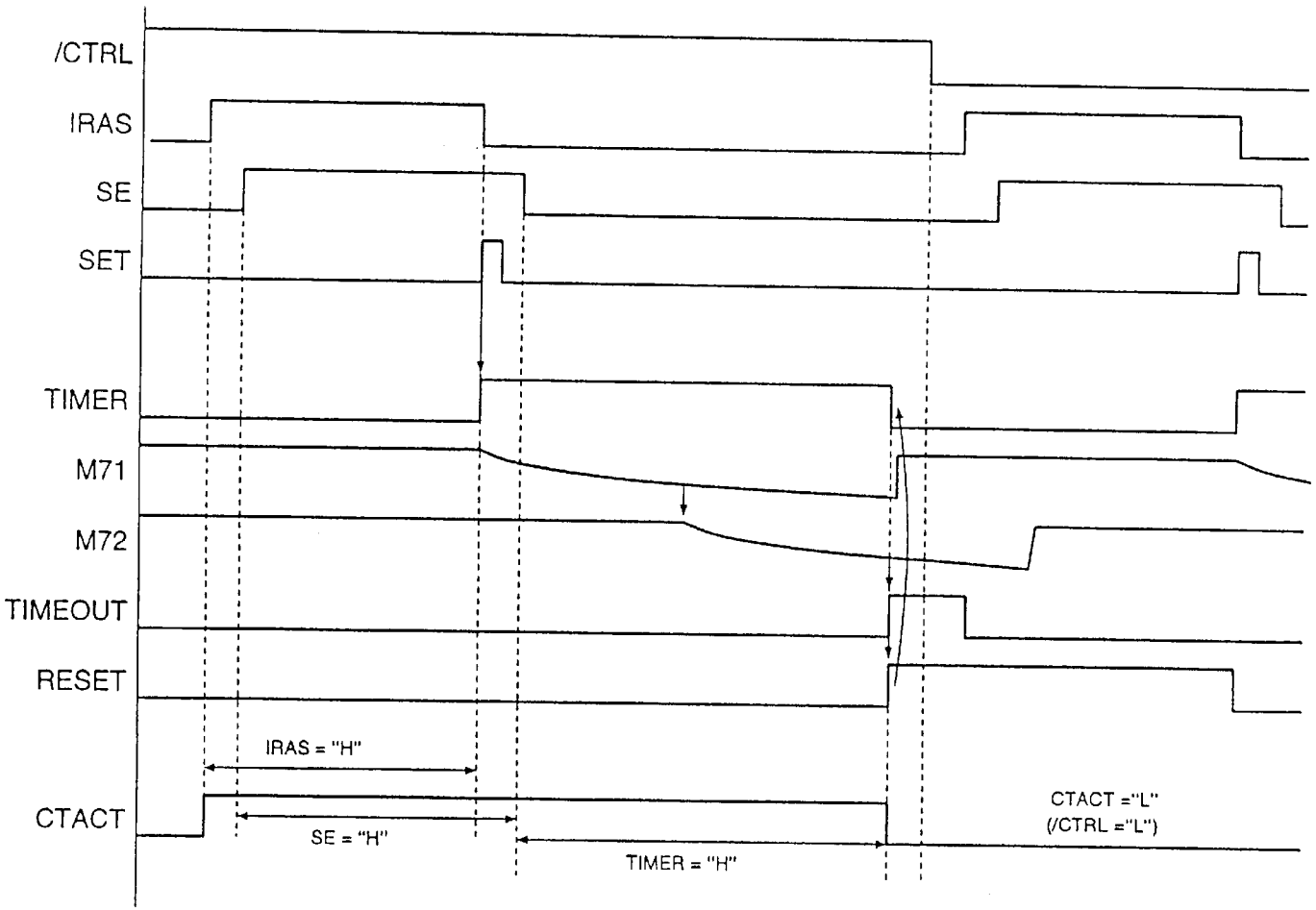
FIG. 10 is a timing chart of the control signal generating circuit.

FIG. 9 shows a circuit for generating a control signal CTACT, and FIG. 10 shows a timing chart of the operation thereof.

In FIG. 9, the control signal CTACT is generated by a signal IRAS in which a reversal signal of a row address strobe signal /RAS produced in the control circuit of the DRAM is synchronized with a clock, a sense amplifier starting signal SE, and the above-described control signal /CTRL.

That is to say, the results of NAND are obtained at a NAND gate X7C for a signal in which the signal IRAS is delayed for a predetermined time by a buffer X7A and a signal in which the signal IRAS is reversed in logic by an inverter X7B. Meanwhile, the results of NOR are obtained at a NOR gate X7M for a signal in which the signal IRAS is reversed in logic by the inverter X7B and a timeout signal, whereby a pulse with a predetermined width is generated in synchronization with a trailing edge of the signal IRAS. These signals are input to a set terminal of a flip flop composed of two NANDs gates X7D and X7E, whereby an internal node TIMER assumes a high level.

Although a transistor Q71 is turned off, which causes an internal node M71 to try to change to be at a low level due to an inverter X7H, the potential of the internal node M71 gradually varies due to a resistor R71 formed between the output of the inverter X7H and the internal node M71 and a capacitor C71 formed between the internal node M71 and the ground potential, as shown in FIG. 10.

When the potential of the internal node M71 is below a switching level of an inverter X7J, an input of an inverter X7K and a transistor Q72 changes to be at a high level. Also, when due to a resistor R72 and a capacitor C72 the potential of a node M72 gradually varies, and the voltage of the node M72 is below a switching level of an inverter X7L, an output TIMEOUT changes from a low level to a high level. A node RESET changes from a low level to a high level due to a NOR gate X7M, and a node TIMER assumes a low level, so that an entire timing generating circuit X7T returns to an initial state because the nodes M71 and M72 assume a high level.

As described above, a signal TIMER that is generated in a timing generating circuit X7T and assumes a high level for a predetermined period and a signal obtained by calculating the results of OR of the signals IRAS and SE at an OR gate X7F are active timing of the VBP power source circuit when a memory is activated.

When the control signal /CTRL is at a high level, these signals pass through an AND gate X7G and are output as the control signal CTACT. However, when the control signal /CTRL is at a low level, the output of the control signal /CTRL has priority over other signals, and the control signal CTACT assumes a low level at all times. When the control signal /CTRL is at a low level, as described above, the differential amplifiers AMP1 and AMP2 stop operating, and the differential amplifier AMP3 also stops simultaneously in the same way.

Therefore, the control signal /CTRL is set at a low level, whereby a test for applying the output VBP from the outside becomes possible.

As a procedure of the test, the control signal /CTRL is set at a low level, elements capable of sufficiently conducting a memory operation by the application of the output VBP or other power source voltages from an outside are extracted, and information on the position and the value of the most appropriate output voltage VBP and other voltages are recorded.

Then, as a second procedure, in order to control the output voltage VBP, fuses F11 to F14 or F41 to F44 are turned off to optimize the output voltage VBP.

Finally, as a third procedure, various kinds of function tests are conducted under the condition that various power source circuits are operated. The control circuit of the DRAM using the present semiconductor integrated circuit includes a test mode for conducting a read/write operation with respect to a memory cell, only a redundant address of which is selected. With respect to the test mode for accessing this redundant address, a mode for applying the output voltage VBP from the outside, i.e., a mode for setting the control signal /CTRL at a low level, is defined. After making the output voltage VBP appropriate and testing whether a redundant relief address can be used or not, or presence or absence of defects, various kinds of function tests are conducted by using the power source circuit, and a time needed for testing the entire circuit is shortened, whereby the test cost is reduced.

Figure 11:
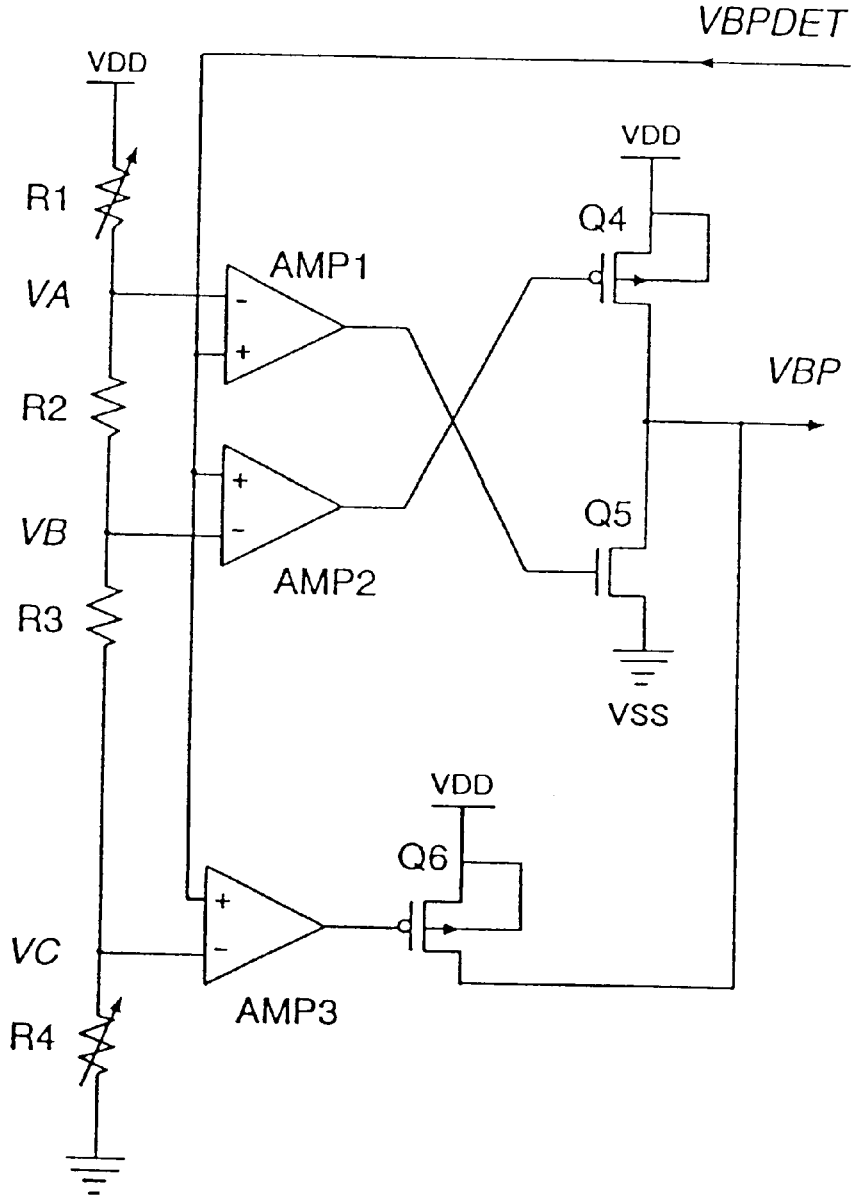
FIG. 11 is an exemplary view showing a separation of a power source voltage output portion from a detection input portion in the semiconductor integrated circuit of an embodiment according to the present invention.
Figure 12:
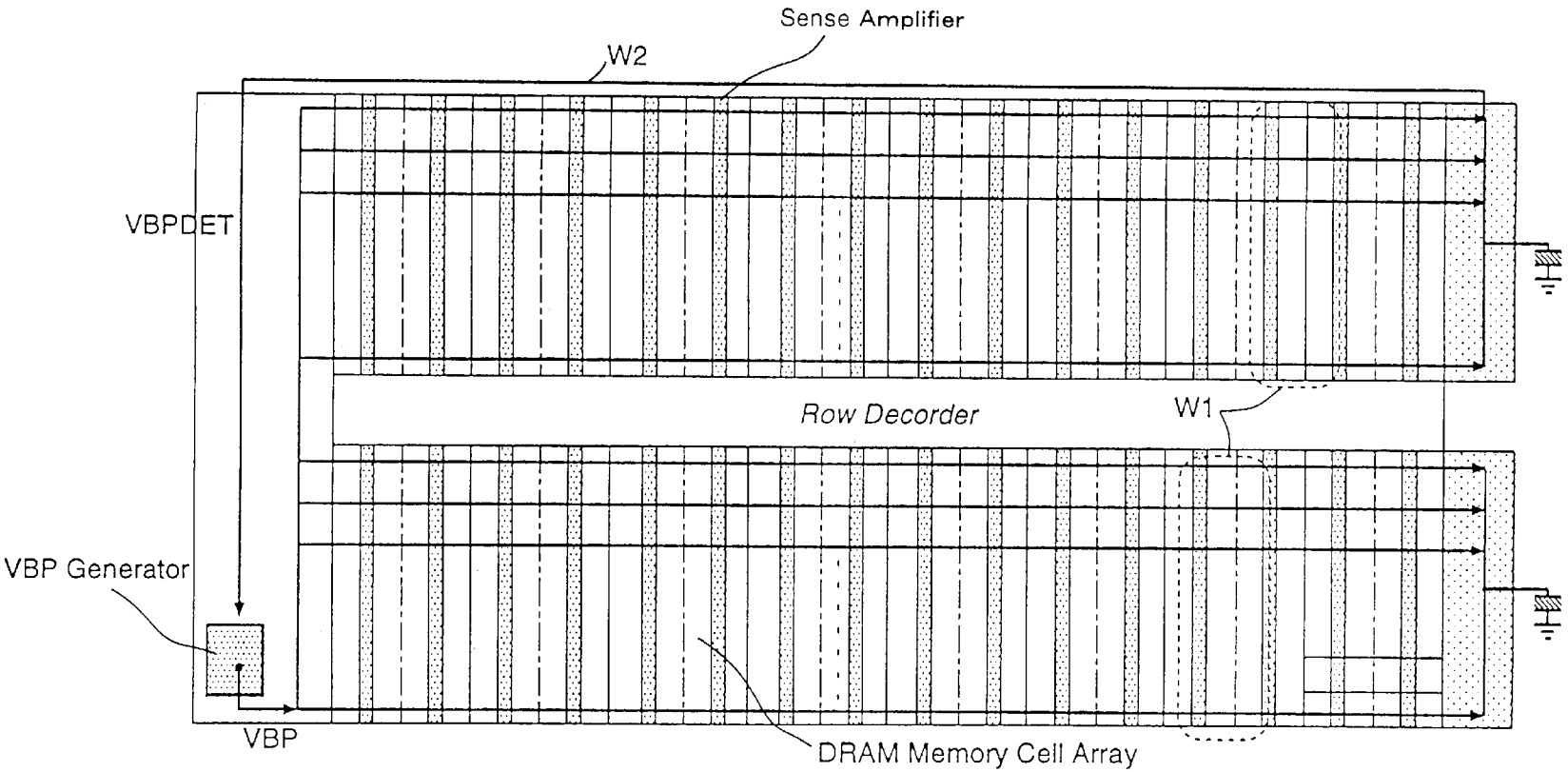
FIG. 12 is an exemplary view showing a power source wiring arrangement of a DRAM.
Figure 13:
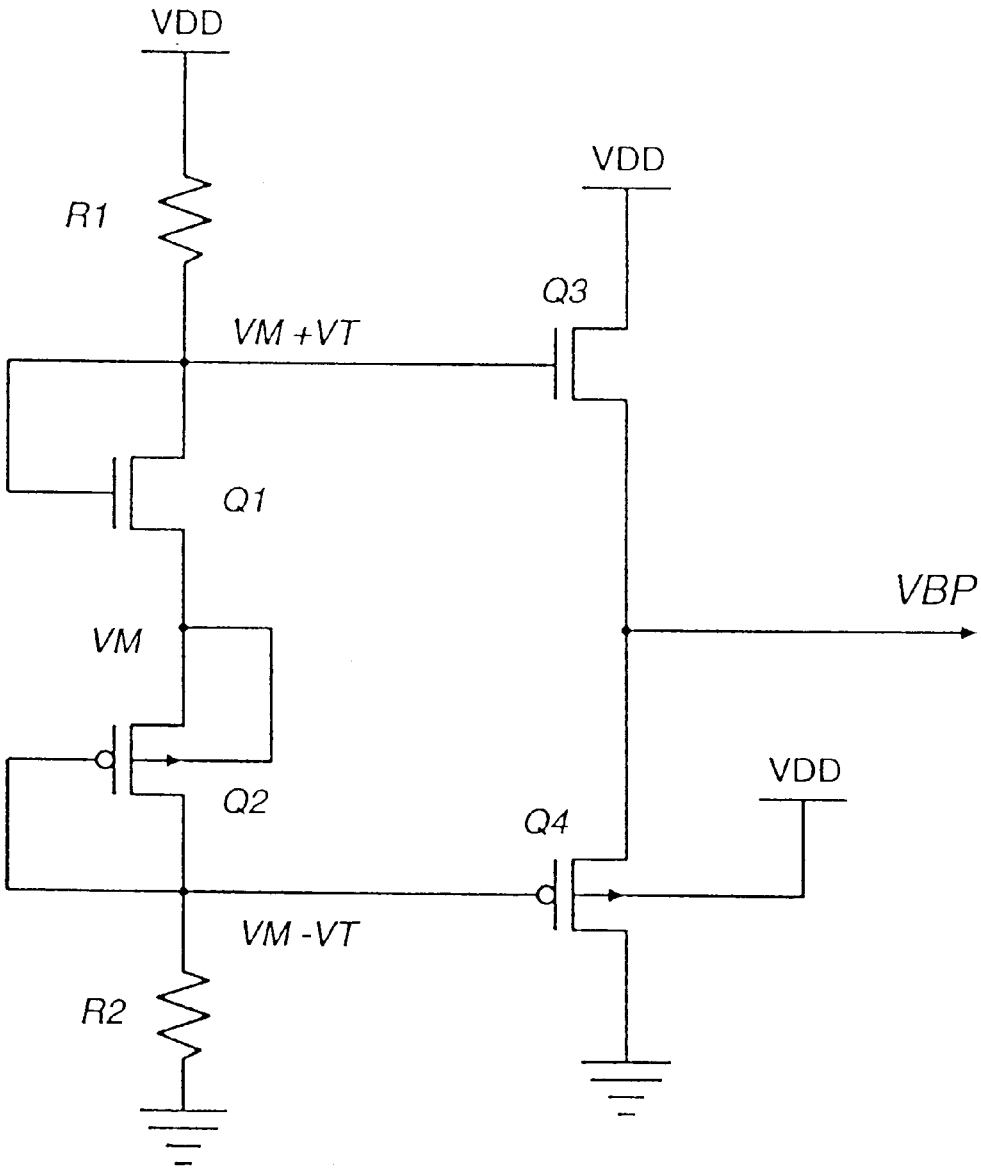
FIG. 13 PRIOR ART
FIG. 13 is an exemplary view of a conventional bit line precharge circuit.
Figure 14:
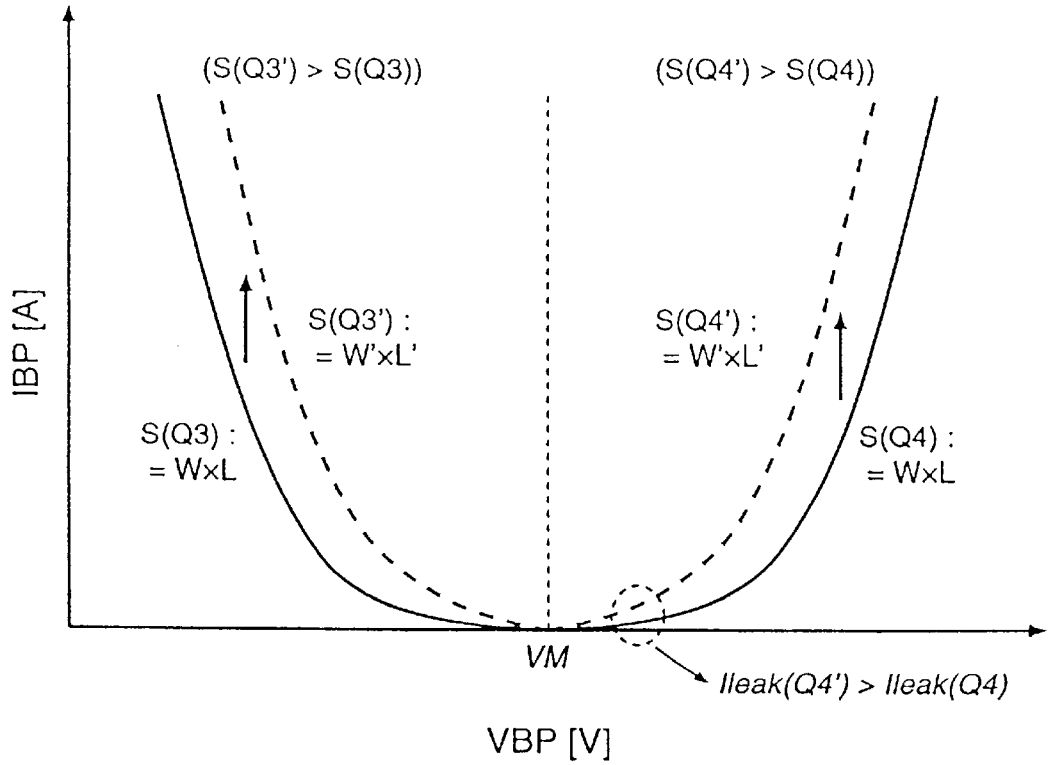
FIG. 14 PRIOR ART
FIG. 14 is an operational characteristic diagram of the conventional bit line precharge circuit.

As shown in FIG. 11, in the semiconductor integrated circuit of the embodiment according to the present invention, the output voltage VBP and one input terminal of the differential amplifiers can be provided independently. An appropriate example of the above described semiconductor integrated circuit includes a layout example of power source wiring of the DRAM as shown in FIG. 12. In FIG. 12, it becomes possible to include a power source wiring system W1 for providing a power source to each bit wire arranged in a memory cell array and a power wiring system W2 that is arranged on the farthest side from the power source wiring system W1 and is independent therefrom for detecting a voltage connected to one input terminal of the differential amplifiers. Also, a timing can be determined for the fluctuation in the voltage of the portions to which the power source is most unlikely to be supplied. That is to say, stabilization of the power source supply can be realized.

In the present embodiment, although resistors are shown with general signs of resistors, the material for resistors is not particularly limited to conductor materials having a high specific resistance, i.e., materials such as polysilicon, and for example, resistance elements or the like of semiconductors in which a gate terminal is connected to a drain terminal of a MOS transistor with common wiring may be used.

As described above, in the semiconductor integrated circuit according to the present invention, the transistors driven so as to prevent the fluctuation in the output voltage VBP have sharp current capability characteristics with respect to the fluctuation in voltage in order to vary a gate voltage dynamically and have a sharp transient response. At the same time, the area of the driving transistors can be reduced.

Since the second power source voltage that is higher than a power source voltage used for other parts of the circuit is introduced into the power source voltage of the differential amplifier driving one transistor, a wide voltage region in which the differential amplifier operates is obtained, so that the operation of the power source can be set in a wide range.

Since the power source voltage circuit has a function of stopping the operation of the circuit for the test thereof, the test can be conducted easily under the condition that the power source does not operate. Therefore, before the test under the condition that the power source operates, samples with defects and those not satisfying the test standard can be removed, whereby the number of the samples for the test under the condition that the power source operates can be limited, a test time can be shortened, and the test cost can be reduced.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A semiconductor integrated circuit, comprising a functional circuit and a power source voltage generating circuit used for operating the functional circuit, wherein the power source voltage generating circuit comprises a first differential amplifier, a second differential amplifier, a third differential amplifier, a first transistor, a second transistor, and a third transistor, gate terminals of the first, the second, and the third transistors are connected to output terminals of the first, the second, and the third differential amplifiers, respectively, drain terminals of the first, the second, and the third transistors are connected to either a first power source potential or a ground potential, source terminals of the first, the second, and the third transistors are connected to an output terminal, and one input terminal of each of the first, the second, and the third differential amplifiers is connected to the output terminal, the other input terminal of each of the first, the second, and the third differential amplifiers receives a first reference voltage, a second reference voltage, and a third reference voltage, respectively, the first, the second, and the third reference voltages being different from one another.

2. A semiconductor integrated circuit, comprising a functional circuit and a power source voltage generating circuit used for operating the functional circuit, wherein in the power source voltage generating circuit, transistors of an output stage are driven by a pair of differential amplifiers receiving reference voltages having a voltage difference at operation points, and in a differential amplifier different from the pair of differential amplifiers, a reference voltage different from the reference voltages input to the pair of differential amplifiers is compared with an output voltage from the transistors of the output stage, the power source voltage generating circuit comprises a first resistor, a second resistor, a third resistor, and a fourth resistor connected in series to one another, a first differential amplifier, a second differential amplifier, and a third differential amplifier, and a first transistor, a second transistor, and a third transistor, the first resistor connects a terminal on the opposite side of a terminal connected to the second resistor to a first power source potential, the fourth resistor connects a terminal on the opposite side of a terminal connected to the third resistor to a ground potential, gate terminals of the first transistor, the second transistor, and the third transistor are connected to output terminals of the first differential amplifier, the second differential amplifier, and the third differential amplifier respectively, drain terminals of the first transistor, the second transistor, and the third transistor are connected to either the first power source potential or the ground potential, source terminals of the first transistor, the second transistor, and the third transistor are connected to an output terminal, and one input terminal of each of the first differential amplifier, the second differential amplifier, and the third differential amplifier is connected to the output terminal, the other input terminal of the first differential amplifier receives a first reference voltage produced between the first resistor and the second resistor, the other input terminal of the second differential amplifier receives a second reference voltage produced between the second resistor and the third resistor, and the other input terminal of the third differential amplifier receives a third reference voltage produced between the third resistor and the fourth resistor.

3. A semiconductor integrated circuit, comprising a functional circuit and a power source voltage generating circuit used for operating the functional circuit, wherein in the power source voltage generating circuit, transistors of an output stage are driven by a pair of differential amplifiers receiving reference voltages having a voltage difference at operation points, and in a differential amplifier different from the pair of differential amplifiers, a reference voltage different from the reference voltages input to the pair of differential amplifiers is compared with an output voltage from the transistors of the output stage, the power source voltage generating circuit comprises n resistors (n is a natural number) connected in series to one another, (n−1) differential amplifiers disposed between the continuous resistors and (n−1) transistors corresponding to the differential amplifiers respectively, among the n resistors connected in series to one another, terminals of the resistors disposed on both ends connect terminals that are not connected to the other resistors to the first power source potential and the ground potential respectively, and in each of the differential amplifiers, an output is connected to a gate terminal of the corresponding transistor, one input receives an output voltage connected to a source terminal of the corresponding transistor, and the other input receives a first reference voltage taken out between the corresponding continuous resistors.

4. The semiconductor integrated circuit according to claim 2, wherein among the differential amplifiers constituting the power source voltage generating circuit, an operating power source voltage of the first differential amplifier is driven by a second power source voltage having a higher value than the first power source voltage and the second differential amplifier or the third differential amplifier is driven by the first power source voltage.

5. The semiconductor integrated circuit according to claim 3, wherein among the differential amplifiers constituting the power source voltage generating circuit, continuous k differential amplifiers (k is a natural number, $n \geqq k$) are driven by the second power source voltage having a higher value than the first power source voltage, and the remaining continuous differential amplifiers are driven by the first power source voltage.

6. The semiconductor integrated circuit according to claim 2, wherein the power source voltage generating circuit has a voltage control unit capable of increasing a resistance in the first and fourth resistors.

7. The semiconductor integrated circuit according to claim 3, wherein the power source voltage generating circuit has a voltage control unit capable of increasing a resistance in the resistors disposed on both ends among n resistors connected in series to one another.

8. The semiconductor integrated circuit according to claim 6, wherein the voltage control unit is composed of m fuses (m is a natural number) and m resistors in which the m fuses are connected in parallel to both ends, wherein in the adjoining resistors, a resistance of the output side is twice as high as a resistance of the input side.

9. The semiconductor integrated circuit according to claim 2, wherein the power source voltage generating circuit has control terminals capable of stopping power supply to all of the n differential amplifiers.

10. The semiconductor integrated circuit according to claim 2, wherein the third differential amplifier constituting the power source voltage generating circuit has a second control terminal, and the second control terminal is connected to the gate terminal of the transistor that is connected in parallel to the current source of the third differential amplifier.

11. A semiconductor integrated circuit, comprising a functional circuit and a power source voltage generating circuit used for operating the functional circuit, wherein in the power source voltage generating circuit, transistors of an output stage are driven by a pair of differential amplifiers receiving reference voltages having a voltage difference at operation points, and in a differential amplifier different from the pair of differential amplifiers, a reference voltage different from the reference voltages input to the pair of differential amplifiers is compared with an output voltage from the transistors of the output stage, the power source voltage generating circuit has a first resistor, a second resistor, a third resistor, and a fourth resistor connected in series to one another, a first differential amplifier, a second differential amplifier, and a third differential amplifier, and a first transistor, a second transistor, and a third transistor, the first resistor connects the terminal on the opposite side of a terminal connected to the second resistor to the first power source potential, and the fourth resistor connects a terminal on the opposite side of the terminal connected to the third resistor to the ground potential, the gate terminals of the first transistor, the second transistor, and the third transistor are connected to the output terminals of the first differential amplifier, the second differential amplifier, and the third differential amplifier respectively, drain terminals of the first transistor, the second transistor, and the third transistor are connected to either the first power source potential or the ground potential, source terminals of the first transistor, the second transistor, and the third transistor are connected to the output terminal, and one input terminal of each of the first differential amplifier, the second differential amplifier, and the third differential amplifier receives the output of the power source voltage generating circuit, the other input terminal of the first differential amplifier receives a first reference voltage produced between the first resistor and the second resistor, the other input terminal of the second differential amplifier receives a second reference voltage produced between the second resistor and the third resistor, and the other input terminal of the third differential amplifier receives a third reference voltage produced between the third resistor and the fourth resistor.

12. The semiconductor integrated circuit according to claim 11, comprising wiring for distributing the power source voltage provided from the power source voltage generating circuit to the entire circuit and wiring for measuring a voltage from the farthest position in the provided power source voltage independently, wherein in the power source voltage generating circuit, one input terminal of each of the first differential amplifier, the second differential amplifier, and the third differential amplifier is connected to the end portion of the wiring for measuring the power source voltage.

13. The semiconductor integrated circuit according to claim 7, wherein the voltage control unit is composed of m fuses (m is a natural number) and m resistors in which the m fuses are connected in parallel to both ends, wherein in the adjoining resistors, a resistance of the output side is twice as high as a resistance of the input side.

14. The semiconductor integrated circuit according to claim 3, wherein the power source voltage generating circuit has control terminals capable of stopping power supply to all of the n differential amplifiers.

15. The semiconductor integrated circuit according to claim 1, wherein the drain terminal of the first transistor is connected to the ground potential, and the drain terminals of the second and third transistors are connected to the first power source potential.

16. The semiconductor integrated circuit according to claim 2, wherein the drain terminal of the first transistor is connected to the ground potential, and the drain terminals of the second and third transistors are connected to the first power source potential.

17. The semiconductor integrated circuit according to claim 11, wherein the drain terminal of the first transistor is connected to the ground potential, and the drain terminals of the second and third transistors are connected to the first power source potential.

18. The semiconductor integrated circuit according to claim 15, wherein each of the first, the second and the third reference voltages is in a voltage range between the first power source potential and the ground potential, and the second reference voltage is lower than the first reference voltage and higher than the third reference voltage.

* * * * *